US007634328B2

(12) United States Patent
Medizade et al.

(10) Patent No.: US 7,634,328 B2
(45) Date of Patent: Dec. 15, 2009

(54) METHOD, SYSTEM AND COMPUTER PROGRAM PRODUCT FOR MONITORING AND OPTIMIZING FLUID EXTRACTION FROM GEOLOGIC STRATA

(76) Inventors: Masoud Medizade, 128 Twin Ridge Dr., San Luis Obispo, CA (US) 93405; John Robert Ridgely, 355 Highland Dr., Los Osos, CA (US) 93402

( * ) Notice: Subject to any disclaimer, the term of this patent is extended or adjusted under 35 U.S.C. 154(b) by 760 days.

(21) Appl. No.: 10/760,437

(22) Filed: Jan. 20, 2004

(65) Prior Publication Data

US 2005/0158179 A1 Jul. 21, 2005

(51) Int. Cl.

| | |
|---|---|
| ***G05D 7/00*** | (2006.01) |
| ***G01N 15/08*** | (2006.01) |
| ***G01F 1/00*** | (2006.01) |
| ***G06F 11/00*** | (2006.01) |

(52) U.S. Cl. ..... 700/282; 700/14; 700/28; 702/12; 702/45; 702/188; 137/2

(58) Field of Classification Search ..... 700/14, 700/28, 282; 702/2, 6, 9, 11–13, 45–49, 702/188; 137/2

See application file for complete search history.

(56) References Cited

U.S. PATENT DOCUMENTS

| | | | | |
|---|---|---|---|---|
| 3,559,731 | A | 2/1971 | Stafford | 166/53 |
| 3,632,923 | A | 1/1972 | Paine et al. | 200/81.9 M |
| 3,838,597 | A | 10/1974 | Montgomery et al. | 73/152.61 |
| 3,857,277 | A | 12/1974 | Moore | 73/861.74 |
| 4,058,757 | A | 11/1977 | Welton et al. | 318/474 |
| 4,171,185 | A | 10/1979 | Duke et al. | 417/12 |
| 4,286,925 | A | 9/1981 | Standish | 417/12 |
| 4,487,061 | A | 12/1984 | McTammaney et al. | 73/152.61 |
| 4,777,979 | A | 10/1988 | Twerdochlib | 137/554 |
| 4,862,898 | A | 9/1989 | Hudimac et al. | 600/538 |
| 5,006,044 | A | 4/1991 | Walker et al. | 417/12 |
| 5,044,888 | A | 9/1991 | Hester | 417/22 |
| 5,091,612 | A | 2/1992 | Van Fossen | 200/81.9 |
| 5,236,011 | A | 8/1993 | Casada et al. | 137/554 |
| 5,343,826 | A | 9/1994 | Brown et al. | 116/275 |
| 5,362,206 | A | 11/1994 | Westerman et al. | 417/12 |
| 5,732,776 | A * | 3/1998 | Tubel et al. | 166/250.15 |
| 5,941,305 | A | 8/1999 | Thrasher et al. | 166/53 |

(Continued)

OTHER PUBLICATIONS

SPE 62865, "Marginal Expense Oil Well Wireless Monitoring," D.Nelson, H.Trust, Society of Petroleum Engineers, 2000.

*Primary Examiner*—Sean P Shechtman
(74) *Attorney, Agent, or Firm*—J. Curtis Edmondson

(57) ABSTRACT

An arrangement which utilizes an inexpensive flap valve/flow transducer combination and a simple local supervisory control system to monitor and/or control the operation of a positive displacement pump used to extract petroleum from geologic strata. The local supervisory control system controls the operation of an electric motor which drives a reciprocating positive displacement pump so as to maximize the volume of petroleum extracted from the well per pump stroke while minimizing electricity usage and pump-off situations. By reducing the electrical demand and pump-off (i.e., "pounding" or "fluid pound") occurrences, operating and maintenance costs should be reduced sufficiently to allow petroleum recovery from marginally productive petroleum fields. The local supervisory control system includes one or more applications to at least collect flow signal data generated during operation of the positive displacement pump. No flow, low flow and flow duration are easily evaluated using the flap valve/flow transducer arrangement.

13 Claims, 7 Drawing Sheets

U.S. PATENT DOCUMENTS

| | | | | |
|---|---|---|---|---|
| 5,970,801 | A | 10/1999 | Ciobanu et al. | 73/861.52 |
| 6,032,540 | A | 3/2000 | Hawkins | 73/861.75 |
| 6,085,599 | A | 7/2000 | Feller | 73/861.13 |
| 6,114,823 | A | 9/2000 | Doner et al. | 318/487 |
| 6,155,347 | A | 12/2000 | Mills | 166/250.03 |
| 6,246,333 | B1 | 6/2001 | Doner et al. | 340/686.1 |
| 6,528,748 | B2 | 3/2003 | Harris et al. | 200/81.9 M |
| 6,937,923 | B1 * | 8/2005 | Bassett | 700/282 |
| 7,242,317 | B2 | 7/2007 | Silvers | |
| 2001/0020901 | A1 | 9/2001 | McHugh et al. | 340/686.1 |
| 2002/0018399 | A1 * | 2/2002 | Schultz et al. | 367/81 |

* cited by examiner

METHOD, SYSTEM AND COMPUTER PROGRAM PRODUCT FOR MONITORING AND OPTIMIZING FLUID EXTRACTION FROM GEOLOGIC STRATA

FEDERALLY SPONSORED RESEARCH AND DEVELOPMENT

This invention was made with Government support under contract DE-FG26-02NT- 15293 awarded by the United States Department of Energy. The Government has certain rights to the invention.

CROSS-REFERENCE TO THE RELATED APPLICATIONS

Not Applicable.

REFERENCE TO A MICROFICHE APPENDIX

Not Applicable.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

The present invention relates generally to a data processing method, system and computer program product and more specifically to a low cost method, system and computer program product for monitoring and optimizing fluid extraction from geologic strata. The invention further provides energy savings and limits pumping equipment wear and tear by minimizing pump runoff conditions.

BACKGROUND

Maximizing the recovery of petroleum from marginally productive domestic oil fields is important to U.S. energy independence goals and national security interests. However, in order to be competitive with imported petroleum, the domestic petroleum must be recovered in a cost efficient manner in order to be commercially viable. Traditionally, techniques for the pumping of petroleum involved either continuously operating a pump unit or controlling the pumping unit with a simple electromechanical timer to avoid peak electrical energy charges. Neither of these techniques is suitable for optimizing the extraction of petroleum from marginally productive oil fields.

Furthermore, these techniques waste electrical energy and cause excessive wear and tear on the pumping equipment, thus increasing operational and maintenance costs which decreases the economic viability of the operation. As a result, marginally productive oil fields are often underutilized due to the high electrical energy costs incurred and resulting low production yields resulting from the production wells.

In order to efficiently extract petroleum from these marginal oil fields, a system should be employed which detects when a pumping system encounters an abnormal pumping situation. For example, a commonly encountered abnormal pumping situation is known as "fluid pound".

Fluid pound occurs when the drawing well is pumped-off, i.e., when petroleum is extracted from a well at a rate greater than the rate at which the petroleum is recharged by the petroleum bearing formation. In a pump-off situation, a working well is only partially filled during an upstroke of a plunger. Upon the plunger's downstroke, the plunger strikes or "pounds" the remaining fluid in the working well causing severe jarring of the entire pumping unit which may lead to damage of the pumping unit and decreased pumping efficiency.

Many solutions are known in the relevant art to address the pump-off situations in a petroleum production environment. For example, several references teach measuring changes in the load on a reciprocating member associated with a downhole pump; U.S. Pat. No. 3,838,597 to Montgomery, et al.; U.S. Pat. No. 4,286,925 to Standish; U.S. Pat. No. 5,044,888 to Hester; U.S. Pat. No. 6,155,347 to Mills; measuring current and voltage phase relationships associated with an electrical driving motor U.S. Pat. No. 5,362,206 to Westerman, et al.; measuring the instantaneous rate of both pulsating and steady-state flow; U.S. Pat. No. 5,006,044 to Walker et al.; measuring vibrations incident on reciprocating member associated with a downhole pump, SPE 62865, "Marginal Expense Oil Well Wireless Monitoring," D.Nelson, H.Trust, Society of Petroleum Engineers, 2000; sonically measuring pump-off, U.S. Pat. No. 4,171,185 to Duke, et al.; and expensive hybrid computer controlled systems monitoring a plurality of pump operating parameters, U.S. Pat. No. 5,941,305 to Thrasher, et al.

Although many of these solutions may be effective, these solutions tend to have one or more disadvantages including requiring expensive monitoring equipment, requiring frequent calibration and/or requiring frequent maintenance in the corrosive and toxic environment of marginally productive petroleum fields. As such, the added incremental costs of providing one or more of these solutions generally limit their application to larger and more productive fields. Smaller and marginally productive fields necessarily require low cost and low maintenance solutions in order to be economically viable.

Therefore, it would be highly advantageous to provide a simple, low cost monitoring and control system which maximizes recovery of petroleum, minimizes energy usage and requires minimal ongoing maintenance.

SUMMARY

This invention addresses the limitations described above and provides in a first embodiment, a method for monitoring and optimizing fluid extraction from geological strata which comprises coupling a flow transducer to a flap valve (either pre-existing or newly installed) to a discharge conduit associated with a positive displacement pump. The flow transducer is designed to generate flow signals by detecting movement of a position detectable flap element internal to the flap valve by way of one or more different sensing mechanisms including variable reluctance effects, Hall effects, magnetic inductance effects, binary switch states, potentiometer outputs or piezoelectric effects. The position detectable flap element includes means (mechanical, electrical or magnetic) for stimulating the flow transducer to generate the flow signals coincident with movement of the flap element.

The method embodiment of the invention further provides for electromagnetically coupling the flow transducer to a local supervisory control system, monitoring the flow signals at least during operation of the positive displacement pump, accumulating at least a portion of the flow signals in a memory associated with the local supervisory control system, and determining an optimum pumping cycle from the accumulated flow signals.

In a related method embodiment, an arrangement is provided for transferring at least a portion of the accumulated flow signals from the local supervisory control system to a centralized supervisory control system, outputting the optimized pumping cycle in a format useful for optimizing fluid extraction from the geological strata using the positive displacement pump.

The flow signal transfer process may be accomplished using a telecommunications link, a laptop computer, a personal data assistant, or a data logging device, the flow data transferred from which are then retrievably stored in a data store associated the centralized supervisory control system. The telecommunications link may include electrical, optical, radio frequency or a combination thereof.

In another related method embodiment, an arrangement is provided for electromagnetically coupling a motor controller associated with the positive displacement pump to the local supervisory control system, generating a control signal if the flow signals fall outside a predetermined range or predetermined set point, sending the control signal to the motor controller, and changing an operating state of the positive displacement pump by the motor controller upon receipt of the control signal. The aforementioned predetermined range and predetermined set point includes low or loss of fluid flow and a flow duration in which the positive displacement pump has been operating or idle respectively. The operating state of the positive displacement pump may be turned on or off based on information derived from the flow signals.

In another method embodiment, the invention further provides for determining an optimum pumping cycle from the accumulated flow signals, and outputting the optimized pumping cycle in a format useful for optimizing fluid extraction from the geological strata.

In a systematic embodiment of the invention, a system for monitoring and optimizing fluid extraction from geological strata is provided which comprises: a flow transducer coupled to a flap valve (either pre-existing or newly installed). The flow transducer is designed to generate flow signals by detecting movement of a position detectable flap element internal to the flap valve by way of one or more different sensing mechanisms including variable reluctance effects, Hall effects, magnetic inductance effects, binary switch states, potentiometer outputs or piezoelectric effects.

The position detectable flap element includes means (mechanical, electrical or magnetic) for stimulating the flow transducer to generate the flow signals coincident with movement of the flap element. By way of example, the position detectable flap element includes one or more permanent magnets attached thereto and arranged to stimulate the flow transducer to generate the flow signals coincident with flow induced movement of the position detectable flap element.

The system further provides for a local supervisory control system which is electromagnetically coupled to the flow transducer. The local supervisory control system includes; a first processor; a first memory coupled to the first processor; and an application operatively stored in a portion of the first memory having logical instructions executable by the first processor to; monitor the flow signals generated by the flow transducer during operation of the positive displacement pump, accumulate the flow signals in another portion of the first memory and transfer the accumulated flow signals to an electronic transport medium. Transferring of the accumulated flow signals may occur automatically based at least in part on time, in response to a transfer request issued by the centralized supervisory control system or in response to an event (flow based, detected error condition or coupling of the electronic transport medium to the local supervisory control system.)

The electronic transport medium includes a telecommunications link, a laptop computer, a personal data assistant, or a data logging device. The telecommunications link may include electrical, optical, radio frequency or a combination thereof. In an embodiment of the invention, the telecommunications link is a wireless network.

In a related systematic embodiment, the invention further comprises: a centralized supervisory control system including; a second processor; a data store coupled to the second processor; a second memory coupled to the second processor; and another application operatively stored in a portion of the second memory having logical instructions executable by the second processor to; receive the accumulated flow signals from the electronic transport medium, retrievably store the accumulated flow signals in the data store and output the accumulated flow signals in a format useful for optimizing fluid extraction from the geological strata using the aforementioned positive displacement pump.

In another related systematic embodiment, the application associated with the local supervisory control system further includes instructions executable by the first processor for; transmitting a control signal to an electromagnetically coupled motor controller associated with the positive displacement pump if the flow signals fall outside a predetermined range or predetermined set point.

The aforementioned predetermined range and predetermined set point includes low or loss of fluid flow and a flow duration in which the positive displacement pump has been operating or idle respectively. The operating state of the positive displacement pump may be turned on or off based on information derived from the flow signals.

In a systematic embodiment of the invention, the motor controller includes a timer mechanism for turning the positive displacement pump on or off in accordance with a programmed pumping cycle which can be modified either manually or automatically to utilize the determined optimized pumping cycle.

In another systematic embodiment, the invention provides for generating a control signal if the flow signals fall outside the predetermined range, the flow signals fall outside the predetermined set point, or a control command is received from the centralized supervisory control system. The control command may be generated by the central supervisory control system periodically (time-based) or as a result of an event (flow based or detected error state.)

In a computer program product embodiment of the invention, the invention compromises a computer program product embodied in a tangible form readable by a processor having executable instructions stored thereon for causing the processor to: monitor flow signals generated by a flow transducer, accumulate at least a portion of the flow signals in a memory coupled to the processor, transmit a control signal to an electromagnetically coupled motor controller if the flow signals fall outside a predetermined range or predetermined set point, transfer at least a portion of the accumulated flow signals over a network to another processor, and output the accumulated flow signals in a format useful for optimizing fluid extraction from geological strata using a positive displacement pump.

The programs and associated data may be stored in semiconductor storage media, transportable digital recording media such as a CD ROM, floppy disk, data tape, DVD, or removable hard disk for installation on the centralized supervisory control system or local supervisory control system as one or more transportable computer program products. The programs and associated data comprise executable instructions which are stored in a code format including byte code, compiled, interpreted, compliable or interpretable.

BRIEF DESCRIPTION OF DRAWINGS

The features and advantages of the invention will become apparent from the following detailed description when considered in conjunction with the accompanying drawings. Where possible, the same reference numerals and characters are used to denote like features, elements, components or portions of the invention. It is intended that changes and modifications can be made to the described embodiment without departing from the true scope and spirit of the subject invention as defined in the claims.

Appendix 1—Example C language source code for use in the local supervisory control system.

DETAILED DESCRIPTION

This present invention provides an arrangement which utilizes an inexpensive flow transducer and a simple local supervisory control system to monitor and/or control the operation of a positive displacement pump used to extract petroleum from geologic strata. The local supervisory control system controls the operation of an electric motor which drives a reciprocating positive displacement pump so as to maximize the volume of petroleum extracted from the well per pump stroke while minimizing electricity usage and pump-off situations. By reducing the electrical demand and pump-off (i.e., "pounding" or "fluid pound") occurrences, operating and maintenance costs should be reduced sufficiently to allow petroleum recovery from marginally productive petroleum fields. The local supervisory control system includes one or more applications to at least collect flow signal data generated during operation of the positive displacement pump. No flow, low flow and flow duration are easily evaluated using a flap valve/flow transducer arrangement. The applications are envisioned to be programmed in a high level language such as Java™, C++, C, C#, or Visual Basic™. An example C based program is provided in Appendix 1 to this specification and is herein incorporated by reference. Alternately, applications written for a local supervisory control system may be programmed in assembly language specific to the processor deployed.

Figure 1:
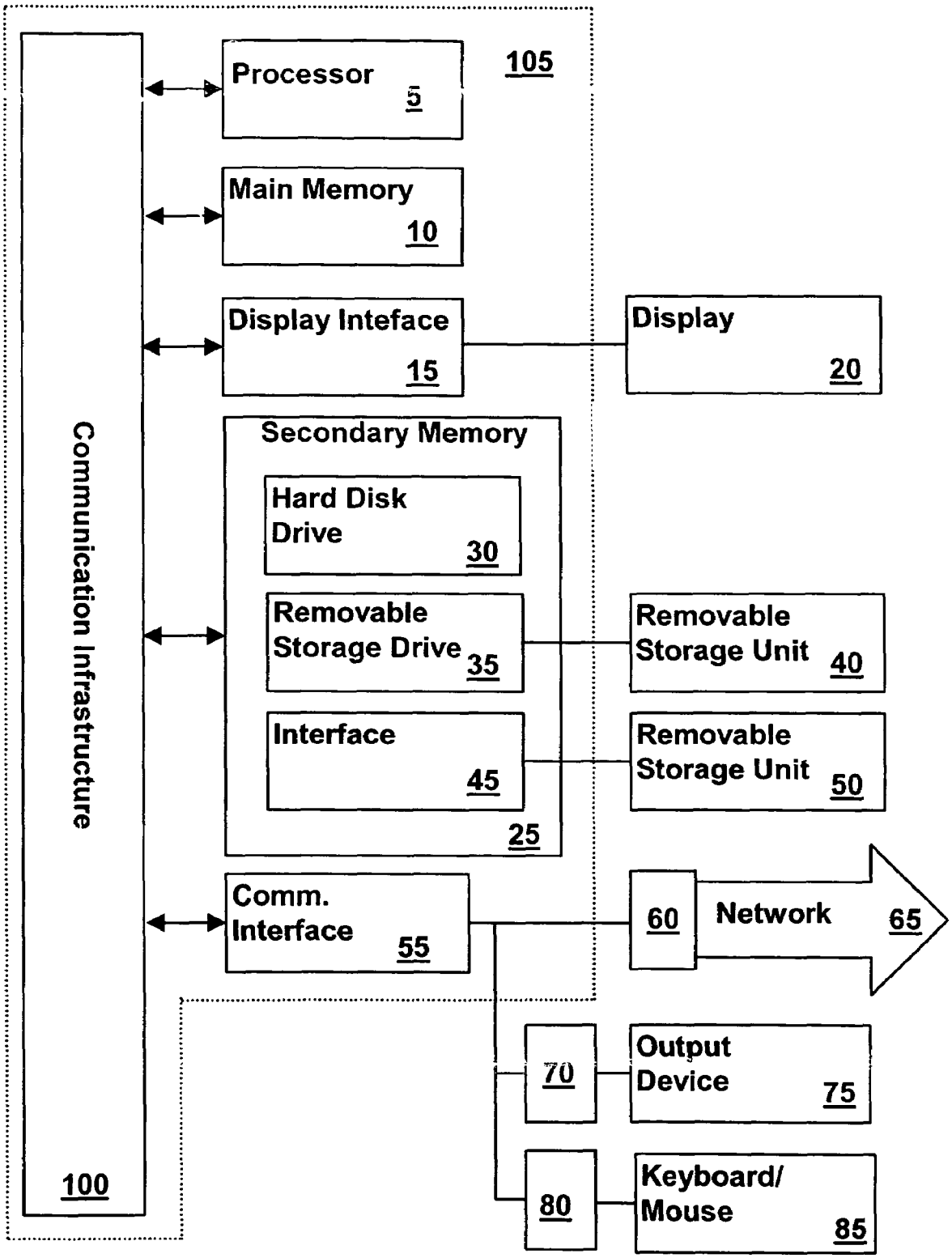
FIG. 1—is a generalized block diagram of a centralized supervisory control system.

Referring to FIG. 1, a functional block diagram of a centralized supervisory control system 105 is shown which includes a central processor 5, a main memory 10, a display 20 electrically coupled to a display interface 15, a secondary memory subsystem 25 electrically coupled to a hard disk drive 30, a removable storage drive 35 electrically coupled to a removable storage unit 40 and an auxiliary removable storage interface 45 electrically coupled to an auxiliary removable storage unit 50.

A standard desktop, workstation, or laptop may be used as the centralized supervisory control system; however, a computer system arranged in a server configuration may be advisable when large numbers of local supervisory control systems are intended to be centrally managed.

A communications interface 55 subsystem is coupled to a network 65 via a network interface 60. An output device 75 such as a printer or plotter is operatively coupled to the communications interface 55 via an output device interface 70. User input devices such as a mouse and a keyboard 85 are operatively coupled to the communications interface 55 via a user interface 80. The auxiliary removable storage unit 50 may include a data logging device which allows the transfer of accumulated flow data to be collected in the field and downloaded into the centralized supervisory control system for analyses rather than receiving the accumulated flow data over the network 65.

The central processor 5, main memory 10, display interface 15 secondary memory subsystem 25 and communications interface system 55 are electrically coupled to a communications infrastructure 100, commonly known as an I/O bus. The centralized supervisory control system 105 includes an operating system, at least one analytical application for at least receiving and reading flow signal data and generating an output of the flow signal data in a format useful for determining an optimum pumping cycle. Additional capabilities of the application include periodically polling or interrogating a local supervisory control system to retrieve the flow signal data and issue control commands to the local supervisory control system. The analytical application may be a standard spreadsheet type office suite application or a proprietary application written specifically for reading and analyzing the flow signal data.

The network 65 includes wireless networks such as BlueTooth, HomeRF, IEEE 802.11 a/b/g and its successors or cellular wireless networks. IEEE 802.20 wired or optical networks may also be employed to communicate with one or more local supervisory control systems addressable over the network 65.

Figure 1A:
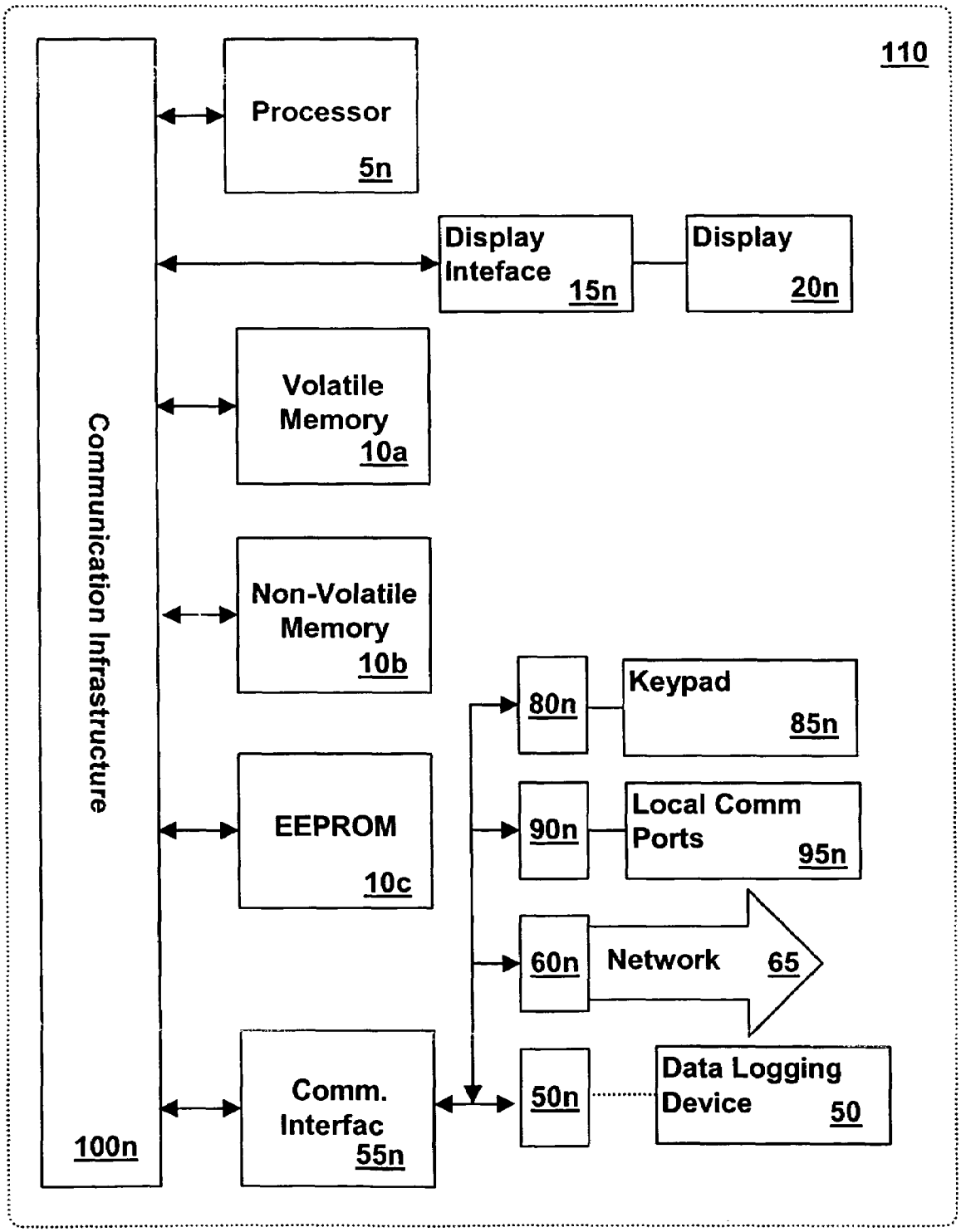
FIG. 1A—is a generalized block diagram of a local supervisory control system.

Referring to FIG. 1A, a functional block diagram of the local supervisory control system is shown 110. The local supervisory control system 110 essentially incorporates the same modular components included in the centralized supervisory control system described above but may lack the hard disk drive 30 and display equipment 15*n*, 20*n* for power conservation.

The local supervisory control system includes a processor 5*n*, volatile memory 10*a*, an optional display 20*n* electrically coupled to an optional display interface 15*n*, a non-volatile memory 10*b* and an electrically erasable programmable read only memory (EEPROM) 10*c*. The volatile and non-volatile memory 10*a*, 10*b* are primarily intended for storage of flow data received from a flow transducer. In addition, the EEPROM 10*c* is intended to contain a run time operating environment and at least one data acquisition and storage application. Additional control applications may also be installed in the non-volatile memory 10*b* to generate control signals. One skilled in the art will appreciate that many memory management configurations are possible including the use of programmable read only memory (PROM).

A communications interface 55*n* subsystem is coupled to the network 65 via a network interface 60*n*, a data logging device 50 is coupled to coupled to a data logging interface 50*n* and a user interface arrangement 85*n* is coupled to a user device interface 80*n* and one or more local communications ports 95*n* are coupled to a communications port interface 90*n*. The processor 5*n*, volatile memory 10*a*, optional display interface 15*n*, non-volatile memory 10*b*, EEPROM (or PROM) 10*c* and communications interface system 55*n* are electrically coupled to a communications infrastructure 100*n*.

The local communications ports 95*n* includes standardized serial communications protocols such as RS-232, RS422, RS423, RS485, or USB. Alternately current loop (4-20 mA) arrangements with an analog to digital (A/D) converter will work as well.

The local communications ports 95*n* are intended to interface with a flow transducer and optionally a motor controller and/or programmable timer associated with an electric motor which drives a positive displacement pump.

The local supervisory control system 110 further includes an operating system either loaded into the EEPROM 10*c* or at least a portion of the non-volatile memory 10*b* along with at least one data acquisition and storage application and one or more communications applications. Optionally control applications may be installed to generate and send control signals to the motor controller and/or programmable timer.

Figure 2:
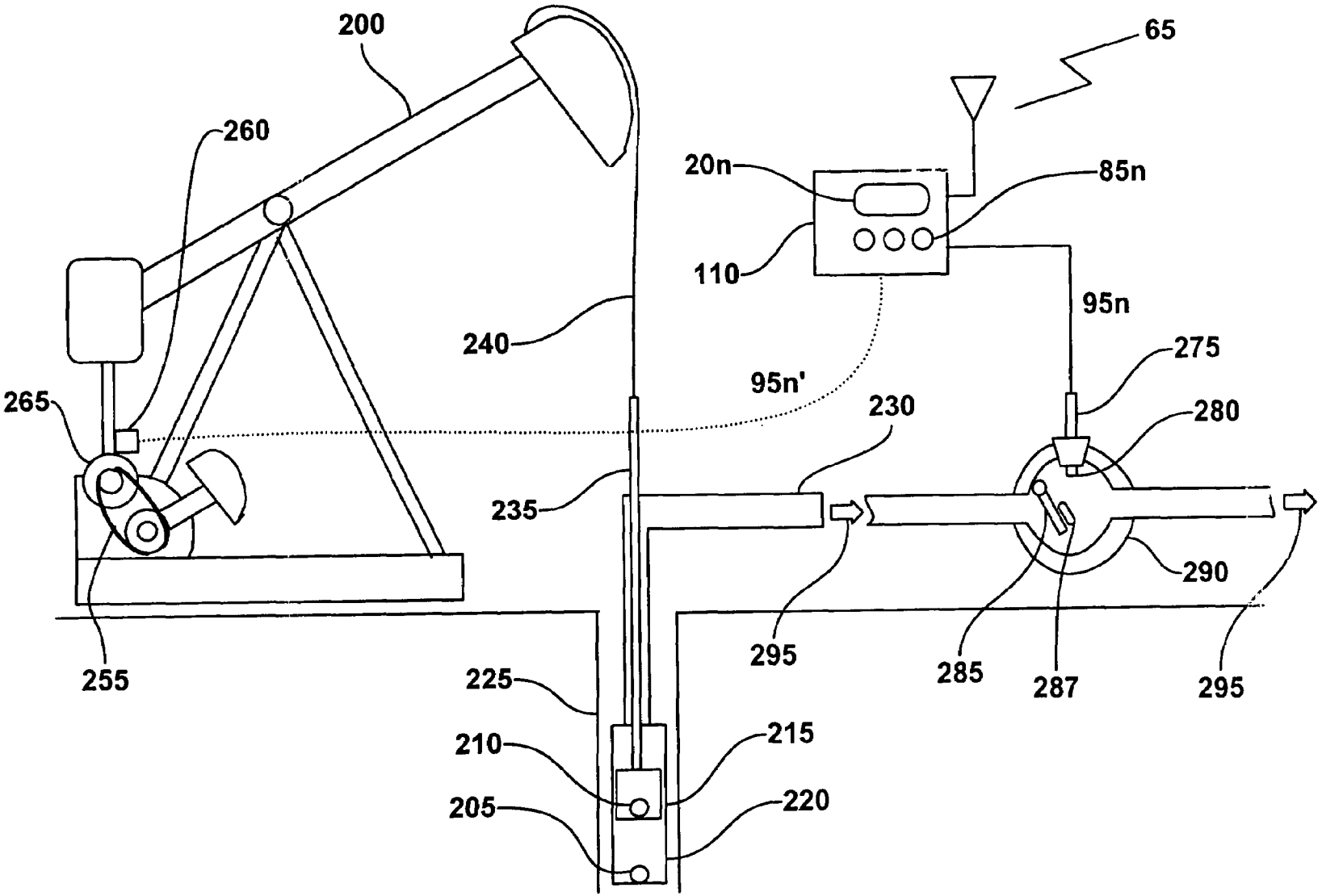
FIG. 2—is a detailed block diagram of one embodiment of the invention depicting the interrelationship of the local supervisory control system, fluid extraction pumping system and a flow transducer.

Referring to FIG. 2, an example arrangement is depicted where extraction of petroleum from the well 225 is being accomplished using a walking beam type pumping unit 200. This type of pumping unit is typically driven by an electric motor 265. The electric motor 265 is coupled to a motor controller 260 or motor control center which controls the operation of the electric motor 265 and hence that of the pump 200.

The electric motor 265 turns a drive belt assembly 255 which causes the walking beam portion of the pumping unit to rise and fall around a pivot point. On a pump upstroke, a traveling valve 210 is closed and the weight of the petroleum fluid in a capture volume 215 is supported by a cable 240 (sucker rod string), allowing fluid to enter a pump barrel 220 through a standing valve 205. On a downstroke, the petroleum fluid in the pump barrel 220 forces traveling valve 210 to open, transferring the fluid load from the cable 240 to the discharge conduit 230.

The discharge of petroleum fluid flows 295 through the discharge conduit 230 and through a flap valve 290. The flap valve 290 is installed in line with the discharge conduit 230 of the downhole pump 230. A flow transducer 275 is coupled to the flap valve 290 which detects movements of an internal flap element 285 caused by the flow of petroleum 295 through the flap valve assembly 290.

The flap valve 290 is usually pre-existing in the discharge conduit 230 and is used as a check valve to prevent the backflow of the extracted fluid 295. As such, only a simple modification is required to be made to the existing flap valve 290. In one embodiment of the invention, the flap element 285 includes or is modified (pre-existing flap valves) to include at least one permanent magnet 287 or an equivalent flow signal generating arrangement. Examples of other acceptable methods of detecting movement of the flap element 285 include variable reluctance effects, Hall effects, magnetic inductance effects, binary switch states (using a reed switch), variable voltage or current (using a potentiometer) flows or piezoelectric effects. In the magnetic embodiment of the invention, movement of the flap element 285 induces a current flow, voltage flow or magnetic field in a sensing element portion 280 of the transducer 275.

The actual detection mechanism employed will likely depend on cost considerations, accessibility of existing check valves, and ability to performance maintenance on the flap valve 290, flap element 285 and flow transducer 275 and sensing element 280. In existing installations, the valve core including the flap element 285 is removed from the valve body 290 and one or more permanent magnets 287 are affixed to the flap element 285. The magnet(s) may be affixed using common fasteners and/or a permanent adhesive (e.g., self-threading bolts, rivets, nut and bolt arrangements or an epoxy adhesive). Alternately, a simple metal bracket having the permanent magnet(s) affixed with a permanent adhesive may then be attached to the flap element 285 using one or more of the fasteners.

In new installations, the construction of the flap element 285 may be of a low cost material compatible with the petroleum fluid and associated vapors such as polyvinyl chloride (PVC), other compatible synthetic polymeric materials or corrosion resistant metal alloys. An example of a flap valve having a suitable flow transducer for use in this invention is described in U.S. Pat. No. 5,236,011 to Casada, et al.

Movement of the flap element 285 causes a flow signal to be transmitted over a communications link 95*n* to the local supervisory control system 110. The communications link may employ electrical, optical or wireless technologies; however, cost considerations may favor a wireless arrangement such as BlueTooth.

Depending on the type of flow transducer 275 employed, an A/D converter and a line transmitter may be required to communicate with the local supervisory control system 110. A delay circuit or logic may also be included to allow sufficient fluid flow to be generated during pump startup. The flow signals generated by the transducer 275 are accumulated in the memory of the local supervisory control system 110. In one embodiment of the invention, the accumulated flow signals are transferred to a centralized supervisory control system over a telecommunications network 65.

Transferring of the accumulated flow signals may occur automatically based at least in part on time, in response to a transfer request issued by the centralized supervisory control system 105 or in response to an event including flow based events, detected error conditions or coupling of the data logging device to the local supervisory control system 110. The data logging device may include a dedicated data logger, a laptop computer, a personal data assistant (PDA), or a PDA equipped cellular telephone adapted to communicate with the centralized supervisory control system 110.

In another embodiment of the invention, the local supervisory control system 110 is coupled to the motor controller 260 by way of another communications link 95*n*'. In this embodiment of the invention, the local supervisory control system 110 both monitors and accumulates the flow signals sent from the flow transducer 275 and includes logic to send control signals to the motor controller 260 as is shown in Table 1 below. One skilled in the art will appreciate that other logic arrangements may be employed as well.

TABLE 1

```
A task/state model algorithm is employed; tasks are intended to be
executed simultaneously through time slicing, cooperative multitasking or
interrupts; each task is assumed to be in one state at any given time.
Variables are shown as [description].Conditional expressions are
shown as (thus).
TASK 1:     SENSOR POLLING
    State 0 - Initialize if (valve closed)
        Transition to valve closed state
    State 1 - Valve closed
        if (valve open signal detected)
        save [time at which opening detected] transition to valve
            open state
    State 2 - Valve open
        if (valve closed signal detected)
        save [time at which closing detected] compute duration of
            time valve was open add time to [total duration of
            open time]
        else if (maximum valve open time exceeded) set stuck valve
            error flag
TASK 2: COMPUTATION OF FLOW AMOUNT
    State 0 - Initialize
        set [total duration of open time] to zero (always) transition
        to waiting/pump on state
    State 1 - Waiting/Pump On
        if (inactive period elapsed)
        if ([total duration of open time] < limit) set [total duration
            of open time] to zero turn pump off record time of
            pump turning off transition to pump off state
        if (maximum pump on time elapsed) set [total duration of
            open time] to zero turn pump off record time of
            pump turning off transition to pump off state
    State 2 Pump Off
        if (preset pump off time exceeded) turn pump on record
            time of pump turning on transition to waiting/pump
            on state
TASK 3: COMMUNICATION
    State 0 - Initialize
        set [percent of time open] array elements to zero (always)
            transition to wait for transmit time state
    State 1 - Wait for Recording Time
        if (error condition detected) transmit error code
            immediately
        if (wait time elapsed) compute new value of percent time
            valve open transition to recording/transmitting state.
State 2 - Recording/Transmitting
    save [percent of time open] in array
    if (time between data transmissions elapsed) transmit ID
        and header information transmit data from array of
        percent times open transmit data from array of
        pump on/off data transmit end of data signal and
        checksum(s)
    (always) transition to wait for recording time state.
```

Figure 3:
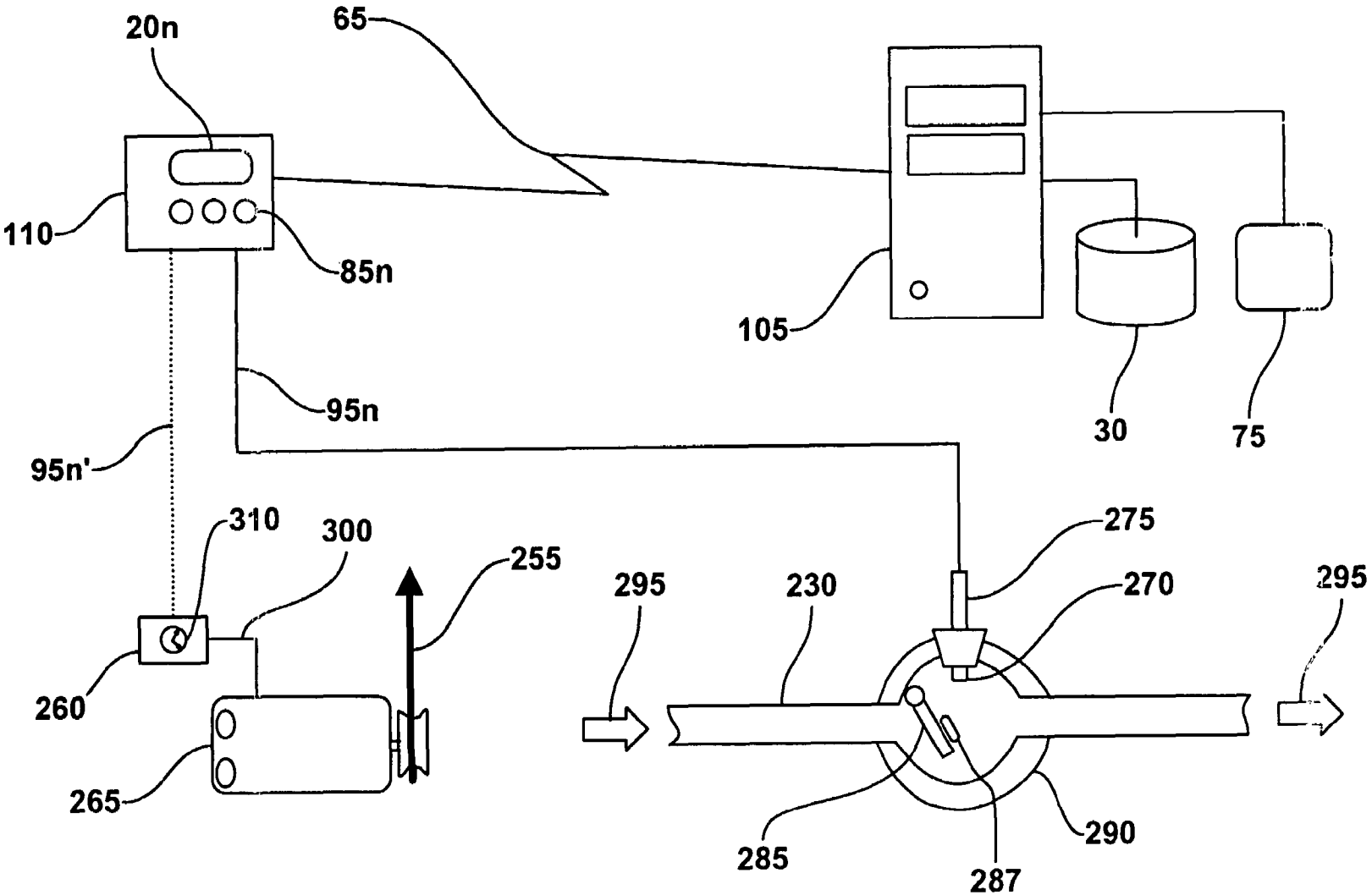
FIG. 3—is a detailed block diagram of one embodiment of the invention depicting the interrelationship of the local supervisory control system, fluid extraction pumping system flow transducer and the centralized supervisory control system.

Referring to FIG. 3, another embodiment of the invention is depicted where the local supervisory control system 110 is in processing communications over a telecommunications network 65 with a centralized supervisory control system 105. In this embodiment of the invention, the centralized supervisory control system 105 periodically polls and/or interrogates the local supervisory control system 110 for accumulated flow signal data obtained from the flow transducer 275. The centralized supervisory control system 105 may also include the ability to determine an optimum pumping cycle in which the motor controller 260 should be operated to maximize petroleum withdrawal from the well 225 shown in FIG. 1, minimize electrical power usage of the electric motor 265, minimize wear and tear on the well pump and drive system 255 and reduce well pump-off. At least one analytical application is provided for receiving and reading flow signal data and generating an output in a format useful for determining an optimum pumping cycle. The analytical application may be a standard spreadsheet type office suite application or a proprietary application written specifically for reading and analyzing the flow signal data. Alternately, the optimum pumping cycle may be determined by an operator after reviewing the accumulated flow signal data.

In one embodiment of the invention, the local supervisory control system 110 includes a telecommunications link 95*n*' with the motor controller 260 and/or a programmable timer 310 coupled to the motor controller 260. In this embodiment of the invention, an optimized pumping cycle is generated by the centralized supervisory control system 105, sent over the network 65 to the local supervisory control system 110 and downloaded over the telecommunications link 95*n*' to the motor controller 260 and/or a programmable timer 310.

An equivalent automated programming of other motor controllers and/or programmable timers is envisioned using other local supervisory control systems in processing communications over the network 65 with the centralized supervisory control system 105. In another embodiment of the invention, the centralized supervisory control system 105 determines an optimized pumping cycle and provides and output on an output device 75 such as a printer or plotter. The output is then used by an operator to manually program the motor controller 260 and/or a programmable timer 310. In an embodiment of the invention, control commands can be sent from the centralized supervisory control system 105 to the local supervisory control system 110 to upload or transfer the accumulated flow signals or to turn the associated positive displacement pump on or off. The control commands may be issued periodically (time based) or in response to a flow based event or detected error state.

Lastly, the centralized supervisory control system 105 is further provided with a data store 30 for maintaining and archiving of flow signal data received from one or more local supervisory controllers over the network or by way of data logging device downloading. The data store 30 is envisioned as a database or parseable file.

Figure 4:
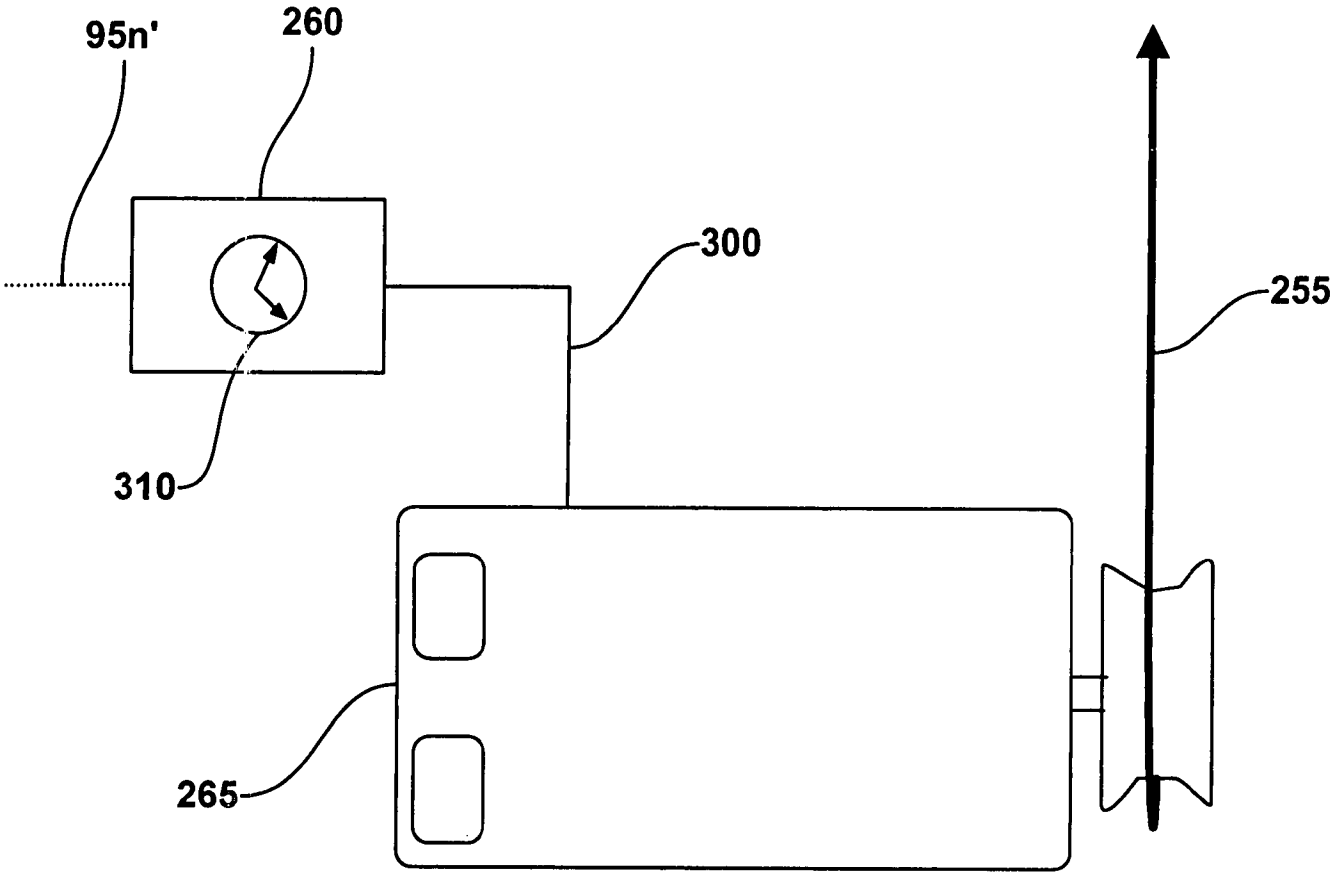
FIG. 4—is a detailed block diagram of one embodiment of the invention depicting a motor controller and programmable time coupled to an electric motor which drives the fluid extraction pumping system.

Referring to FIG. 4, a more detailed view of the motor controller 260 and programmable timer 310 is provided. In one embodiment of the invention, the motor controller and/or programmable timer are coupled to the local supervisory control system via the telecommunications link 95*n*'. In another embodiment of the invention, the motor controller and/or programmable timer are manually programmed by the operator based on the output obtained from the centralized supervisory control system.

Figure 5:
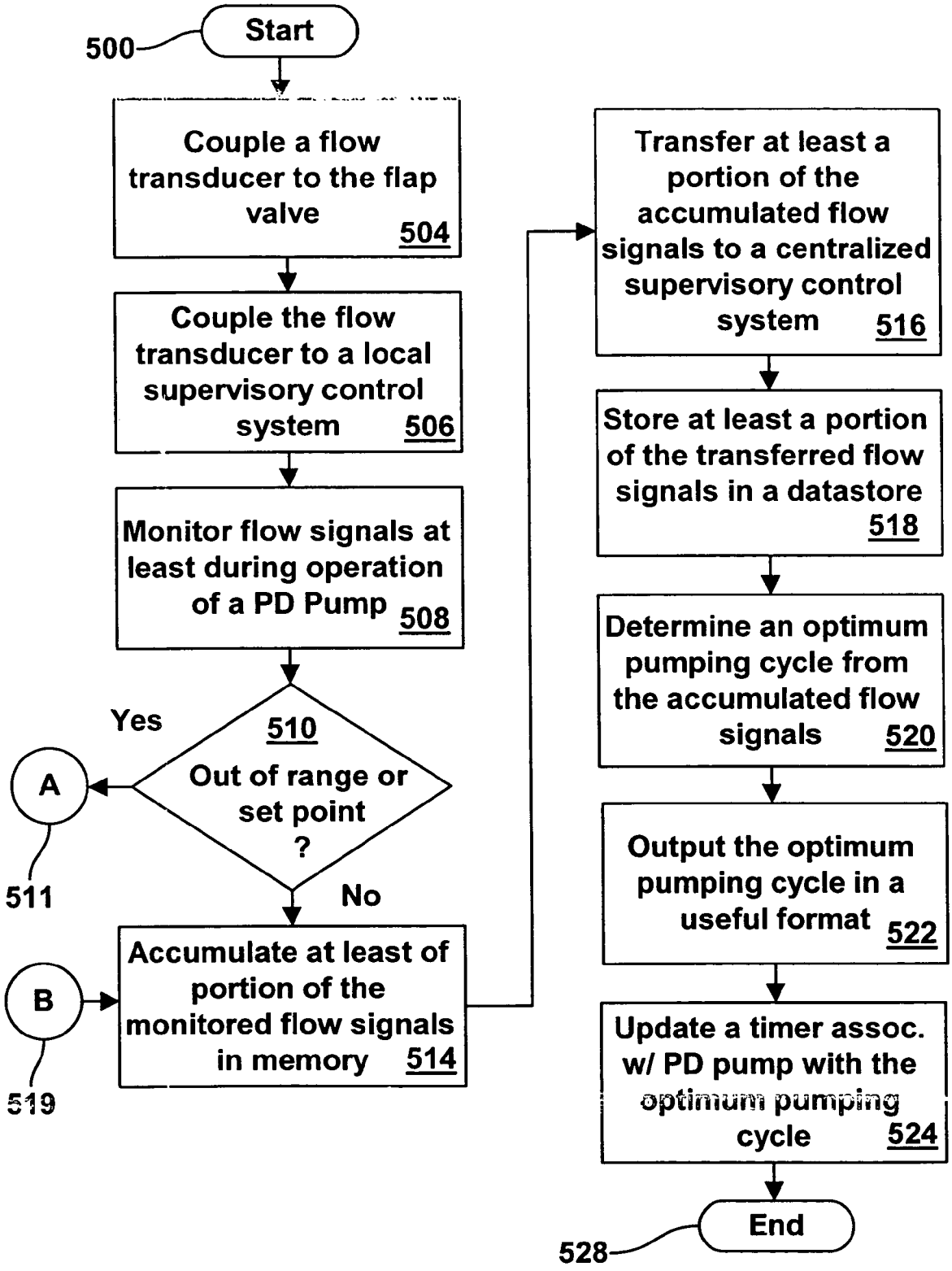
FIG. 5—is a flow diagram of an embodiment of the invention depicting a process arrangement and the major logic incorporated into the local supervisory control system and centralized supervisory control system.

Referring to FIG. 5, a flow chart is provided which illustrates the major process arrangements implemented by the various embodiments of the invention. The process is initiated 500 by the installation or modification of an existing flap valve inline with the discharge conduit associated with a positive displacement pump installed on a petroleum recovery well. A flow transducer which is adapted to sense movement of a flap element internal to the flap valve is then coupled to the flap valve 504. The flow transducer is then electromagnetically coupled to a local supervisory control system 506 which monitors the flow signals generated by the flow transducer at least during operation of the positive displacement pump 508.

The local supervisory control system determines if one or more of the flow signals are out of range or exceed a set point 510. If one or more monitored flow signals are out of range or exceed a set point 510, a control sequence 511 is initiated as described in the discussion for FIG. 5A. If no flow signals are out of range or exceed a set point 510, at least a portion of the monitored flow signals are accumulated in a memory of the local supervisory control system 514. When requested or periodically, at least a portion of the accumulated flow signals are transferred to the centralized the centralized supervisory control system 516 where at least a portion of the transferred flow signals are stored in a data store 518 such as a database or parseable file.

The centralized supervisory control system then determines an optimum pumping cycle from the accumulated flow signals 520 and provides an output in a useful form for operating the positive displacement pump 522. The output is then used to update a timer associated with positive displacement pump 524. The process ends until another optimized pumping cycle is determined 528.

Figure 5A:
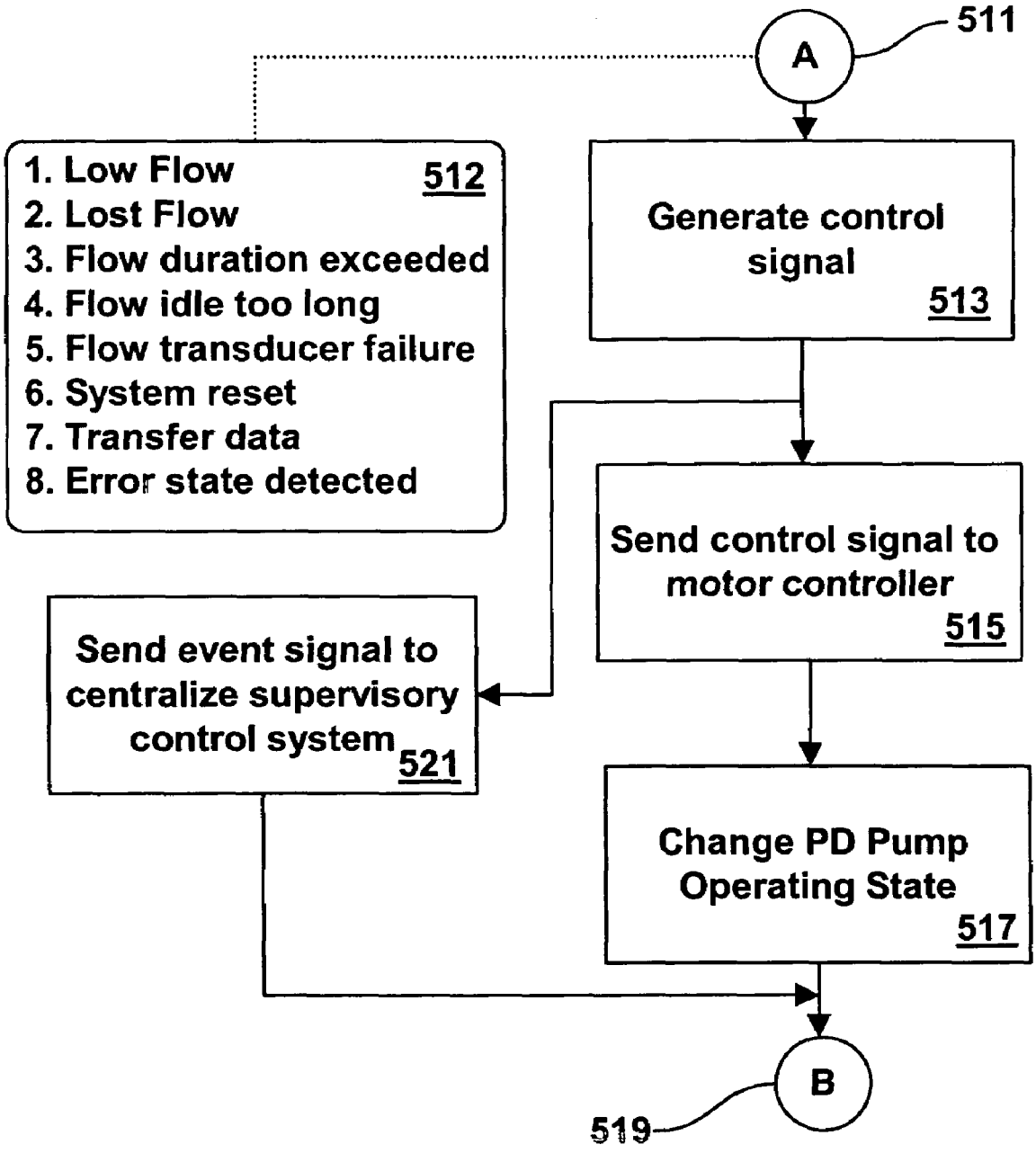
FIG. 5A—is another flow diagram of an embodiment of the invention depicting a process arrangement and the major logic for providing control signals based on monitored flow signals.

Referring to FIG. 5A, if one or more monitored flow signals are out of range or exceed a set point, a control sequence is initiated 511. The control sequence may be initiated due to a low or lost flow condition, flow duration exceeded, flow idle too long, flow transducer failure, system reset, transfer command received, or an error state detected 512. A control signal is then generated 513 and sent to at least a motor controller 515. The motor controller then causes a change in the operating state of the positive displacement pump. The process continues to accumulate at least a portion of the monitored flow signals in memory 519 as is provided in the discussion for FIG. 5. In another embodiment of the invention, one or more event signals are also sent to the centralized supervisory control system for logging, operator interaction and archival purposes 521.

The foregoing described embodiments of the invention are provided as illustrations and descriptions. They are not intended to limit the invention to precise form described. In particular, it is contemplated that functional implementation of the invention described herein may be implemented equivalently in hardware, software, firmware, and/or other available functional components or building blocks. No specific limitation is intended to a particular operating environment. Other variations and embodiments are possible in light of above teachings, and it is not intended that this Detailed Description limit the scope of invention, but rather by the Claims following herein.

```
//                              APPENDIX 1 Example C Source Code
//      File:
//              poff.cc
//      Program:
//      This program takes data for a pump-off controller. It looks for
//      transitions on the sensor line and reports them. This version
//      runs on a laptop; a microcontroller version comes next.
//      © 2003 Petrolects, LLC All rights reserved
#include <stdio.h>
#include <stdlib.h>
#include <iostream.h>
#include <iomanip.h>
#include <fstream.h>
#include <unistd.h>                     //For usleep
#include "testtime.h"
#include "serial-bits.h"
#include "bin2a.h"
//      Function:       checkpulse
//      This function looks for pulses on the valve signal line, it measures
//      the duration of pulses and when a pulse is finished it writes the pulse's timestamp
//      and duration to a file.
//      States
//              The state machine in here has these states:
//              1       waiting for a pulse
//              2       pulse is active, waiting for it to end
//
//                              APPENDIX 1 Example C Source Code
int checkpulse (double timeNow, bool valveSignal, ofstream& outStr)
{
static int state = 1;
static double onTime = 0.0;             // Time pulse begins
                                        // Run state machine with a switch statement
switch (state)
        {
                                // If the state is 1 (waiting), react if pulse is seen
        case (1):
                if (valveSignal = = true)       // Transition detected
                {
                onTime = timeNow;               // Save pulse start time
                state = 2;                      // Go to pulse-active state
                }
        break;
                                // If the state is 2 (pulse active), look for the end of pulse
        case (2):
                if (valveSignal == false)       // Transition detected
                }
        {
                                        // Calculate and save the duration
        double duration = timeNow – onTime;
        outStr << onTime << "           "<< duration << endl;
        cout << endl << onTime << " \t" << duration << endl;
        state = 1;                      //      Back to waiting state
        }
break;
```

-continued

```
default:
        cerr << "ERROR in checkpulse( ): Unknown state " << state << endl; return ( );
        };
return state;
}
                                        // © 2003 Petrolects, LLC All rights reserved
// APPENDIX 1 Example C Source Code
//-----------------------------------------------------------------------------------------------------
//                        Main Program Body
//-----------------------------------------------------------------------------------------------------
int main (int argc, char **argv)
{
double timeSec = 0.0;
double duration = 0.0;                  // Test duration in seconds
const long us__per__step = 90000L;      // Microseconds per test step
bool valveSig = false;                  // Signal read from sensor
C__testtimer theTimer;                  // Create a timer object
C__serialbits serPort (0x3F8);          // Serial port bits I/O object
                                        // Parse arguments with which we called
if (argc != 3)
        {
        cerr << "Usage: << argv[0] << " duration datafile " << endl;
        exit (−2);
        }
if (sscanf (argv[1], "%lf", &duration) != 1)
        {
        cerr << "Error: Cannot read test duration, I got " << duration << " sec " << endl;
        exit (−3);
        }
ofstream outFile (argv[2]);
if (!outFile)
        {
        cerr << "Error: Cannot create file " << argv[2] << endl;
        exit (−4);
        }
                                        // Set up serial port outputs, one true one false
serPort.setDTR (true);
serPort.setRTS (false);
//      Do a bunch of tests
while (timeSec <duration)
        {
        timeSec = theTimer.now ( );
        valveSig = serPort.getDCD ( );
        cout    <<checkpulse (timeSec, valveSig, outFile)
                << bin2a (serPort.getMSR ( )) << " "
                << "    \r";
                                        //© 2003 Petrolects, LLC All rights reserved
//              APPENDIX 1 Example C Source Code
        cout.flush ( );
        cout    << setprecision (3) << setw (6) << timeSec
                << " DCD= " << serPort.getDCD ( ) << "        \r";
        cout.flush ( );
                        // Wait for a hopefully fixed amount of time
if (usleep (us__per__step))
        {
        cerr << "usleep failed" << endl; exit (2);
        }
}
//      outFile << index << " \t" << timeDataf index]
cout << endl;
return 0;
}
                                        // © 2003 Petrolects, LLC All rights reserved
```

What is claimed:

1. A method for monitoring and optimizing fluid extraction from geological strata comprising:

modification of a check valve, said check valve including a flap element, such that the modification further comprises the sequential steps of removing the check valve, locating the flap element, attaching a magnet to the flap element, and reinserting the check value, such that the magnetic field is detectable by a flow transducer;

coupling the flow transducer to the check valve operatively coupled to a discharge conduit associated with a walking beam type pumping unit, wherein said flow transducer is adapted to generate flow signals by detecting movement of a sensing element associated with said check valve, electromagnetically coupling said flow transducer to a local processing system, monitoring said sensing element and said flow signals at least during operation of said walking beam type pumping unit, A/D conversion of said flow signals by a sensing element to create flow signal data;

accumulating a portion of the flow signal data in a memory associated with said local processing system, and determining an optimum pumping cycle from said accumulated flow signal data, wherein said optimum pumping cycle eliminates fluid pound.

2. The method according to claim 1 further including;

transferring a portion of said accumulated flow signal data from said local processing system to another processing system, and outputting said optimized pumping cycle in a format useful for optimizing fluid extraction from said geological strata using said walking beam type pumping unit pump.

3. The method according to claim 1 further including;

electromagnetically coupling a motor controller associated with said pump to said local processing system, generating a control signal if a least a portion of said flow signal data that fall outside a predetermined range or predetermined set point, and sending said control signal to said motor controller;

wherein said motor controller changes an operating state of said pump upon receipt of said control signal.

4. The method according to claim 2 further including storing a portion of said accumulated flow signal data in a data store associated at least with said another processing system.

5. The method according to claim 1 wherein said flow transducer generates said flow signal data based at least in part on one of, variable reluctance effects, Hall effects, magnetic inductance effects, binary switch states, potentiometer outputs or piezoelectric effects.

6. The method according to claim 2 wherein said transferring of said flow signal data is accomplished using an electronic transport medium, wherein said electronic transport medium comprises one of;

a telecommunications link, a laptop computer, a personal data assistant, or a data logging device.

7. The method according to claim 3 wherein said operating state includes turning said walking beam type pumping unit, on or off.

8. The method according to claim 3 wherein said predetermined range includes low or loss of fluid flow.

9. The method according to claim 3 wherein said predetermined set point includes a flow duration in which said walking beam type pumping unit, has been operating or idle.

10. The method according to claim 1 wherein said position detectable element of said check valve includes means for stimulating said flow transducer to generate said flow signal data coincident with said movement.

11. A method for monitoring and optimizing fluid extraction from geological strata comprising:

modification of an inline check valve, said check valve including a flap element, such that the modification further comprises the sequential steps of removing the check valve, locating the flap element, attaching a magnet to the flap element, and reinserting the check value, such that the magnetic field is detectable by a flow transducer;

coupling the flow transducer to the inline check valve installed on a discharge conduit associated with a positive displacement walking beam type pumping unit, wherein said flow transducer is adapted to generate flow signals by detecting movement of a position detectable element of said check valve_and monitoring a sensing element, A/D conversion of the flow signals by a sensing element to create flow signal data;

electromagnetically coupling said flow transducer to a local supervisory control system, monitoring said flow signal data generated at least during operation of said positive displacement walking beam type pumping unit, accumulating a portion of said flow signal data in a memory associated with said local supervisory control system, transferring a portion of said accumulated flow signal data from said local supervisory control system over a network to a centralized supervisory control system, determining an optimum pumping cycle from said accumulated_flow signal data, and outputting said optimized pumping cycle in a format useful for optimizing fluid extraction from said geological strata using said positive displacement walking beam type pumping unit, such that said optimize pumping cycle eliminates fluid pound.

12. A method for monitoring and optimizing fluid extraction from geological strata comprising:

modifying a flap valve, said flap valve including a flap element, such that the modification further comprises the sequential steps of removing the flap valve, locating the flap element, attaching a magnet to the flap element, and reinserting the flap value, such that the magnetic field is detectable by a flow transducer;

coupling the flow transducer to the flap valve operatively coupled to a discharge conduit associated with a positive displacement walking beam type pumping unit, wherein said flow transducer is adapted to generate flow signals by detecting movement of a position detectable sensing element internal to said flap valve, electromagnetically coupling said flow transducer to a local supervisory control system, monitoring said sensing element and said flow signals at least during operation of said positive displacement walking beam type pumping unit, A/D conversion said flow signals and monitoring said sensing element to create digital flow data;

accumulating a portion of said flow signal data in a memory associated with said local supervisory control system, and determining an optimum pumping cycle from said accumulated flow signals, wherein said optimum pumping cycle eliminates fluid pound.

13. The method according to claim 12 further including;

transferring a portion of said accumulated flow signal data from said local supervisory control system to a centralized supervisory control processing system, and outputting said optimum pumping cycle in a format useful for optimizing fluid extraction from said geological strata using said positive displacement walking beam type pumping unit.

* * * * *